United States Patent [19]

Tipton

[11] 4,305,804

[45] Dec. 15, 1981

[54] PLATING BARREL CONTACT

[75] Inventor: Norman B. Tipton, Avon Lake, Ohio

[73] Assignee: Harshaw Chemical Company, Cleveland, Ohio

[21] Appl. No.: 148,154

[22] Filed: May 7, 1980

[51] Int. Cl.[3] ..... C25D 17/20

[52] U.S. Cl. ..... 204/213; 204/279

[58] Field of Search ..... 204/213, 214, 212, 279

[56] References Cited

U.S. PATENT DOCUMENTS

| | | | |
|---|---|---|---|
| 3,058,902 | 10/1962 | Neilson | 204/213 |
| 3,152,060 | 10/1964 | Belke | 204/213 |
| 3,205,159 | 9/1965 | Neilson | 204/213 |
| 3,256,170 | 7/1968 | Neilson | 204/213 |
| 3,340,170 | 9/1968 | Marulli et al. | 204/213 |
| 3,394,070 | 7/1968 | Neilson | 204/213 |
| 3,663,410 | 5/1972 | Schumacher | 204/213 |
| 3,850,737 | 11/1974 | Lui | 204/213 |

FOREIGN PATENT DOCUMENTS

| | | | |
|---|---|---|---|
| 1808807 | 3/1970 | Fed. Rep. of Germany | 204/213 |
| 1940043 | 3/1971 | Fed. Rep. of Germany | 204/213 |
| 537984 | 7/1973 | Switzerland | 204/213 |

*Primary Examiner*—Delbert E. Gantz
*Assistant Examiner*—Donald R. Valentine
*Attorney, Agent, or Firm*—Watts, Hoffmann, Fisher and Heinke Co.

[57] ABSTRACT

A plating barrel having a number of plating electrodes coupled to a constant source of electrical potential outside the barrel and connected to a metal plate which rotates with the barrel. A spring biases a non-rotating conductor against the plate inside the barrel to provide a low resistance path to the constant source outside the barrel. A number of seals prevent plating solution from reaching the contact between plate and conductor to avoid corrosion and/or plating of the contact area.

3 Claims, 3 Drawing Figures

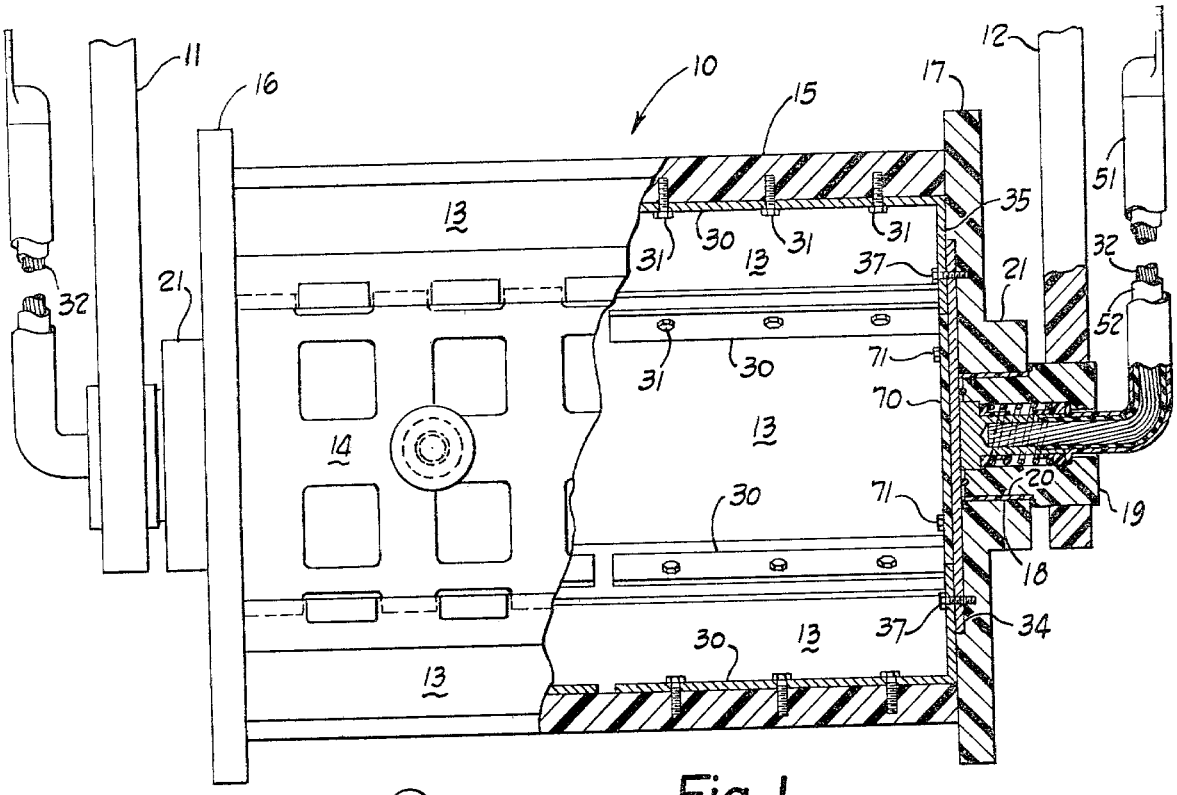
Fig. 1
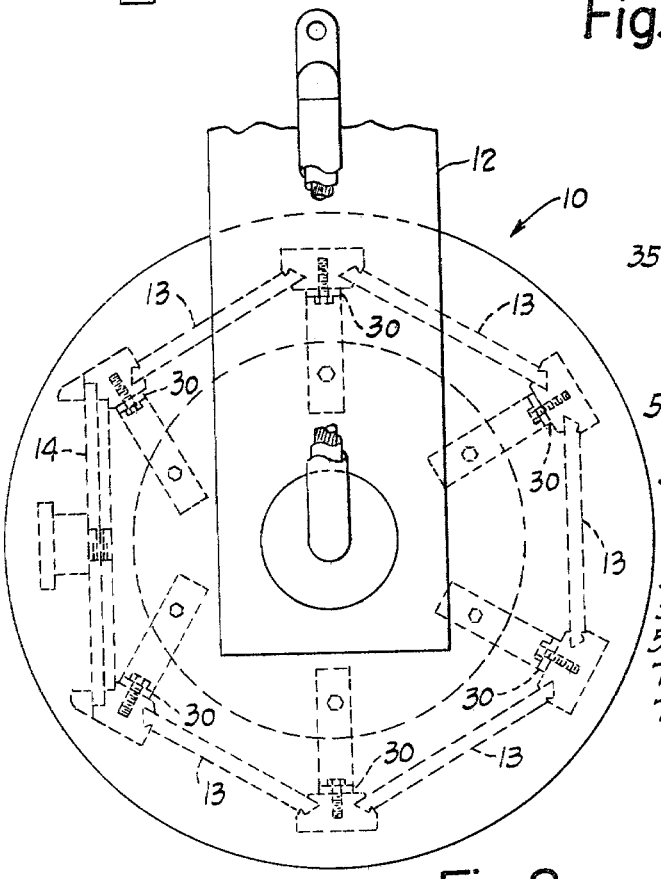
Fig. 2
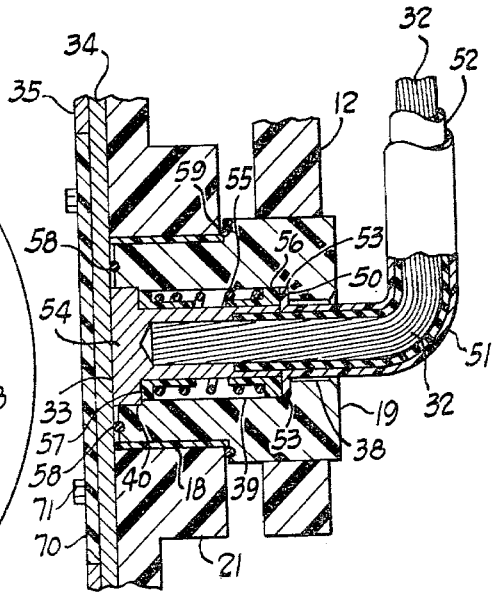
Fig. IA

PLATING BARREL CONTACT

BACKGROUND OF THE INVENTION

1. Field of the Invention

This invention relates generally to an improved plating barrel design and more particularly to method and apparatus for providing an electrical contact to a plating barrel electrode.

2. Prior Art

One technique for electroplating small or medium size metal parts is to immerse those parts in a plating bath rich in charged ions and cause electrodeposition of the ions onto the parts. During such a process the parts act as a cathode and supply electrons which combine with the charged ions.

The use of plating barrels for electrodeposition is known in the electroplating art. The parts are placed into a plating barrel which is immersed into a plating vat containing the ion-rich solution. As the plating barrel is rotated in the bath, the plating solution flows through holes in the barrel walls in contact with the parts. The metallic pieces or parts inside the barrel are maintained at a constant potential and current flow to those parts is produced by applying a higher potential to the plating solution. So long as the metallic parts are maintained at a constant potential and adequate mixing of the solution is achieved, electrodeposition will occur.

Various mechanisms have been used to maintain the metallic parts in the plating barrel at a constant potential. One technique discussed in U.S. Pat. No. 3,256,170 to Neilson is to provide a buss bar system whereby a plurality of buss bars are positioned about an interior barrel surface and contact the metallic parts during barrel rotation.

Two other techniques for maintaining the parts at a constant potential are disclosed in U.S. Pat. No. 3,663,410 to Schumacher. One technique is to insert a dangler type cathode conductor into the barrel and allow the parts to come in contact with the dangler. A second alternative technique disclosed in the Schumacher patent is to mount a conductive disc type cathode to a barrel end wall so that regardless of the barrel orientation the parts contact a portion of the disc.

The above three cathode arrangements work with varying degrees of success, but suffer from a common deficiency. The electrical coupling between the source of constant potential outside the barrel and the cathode is subject to failure.

The preferred prior art technique for such coupling is a trunnion type arrangement where a conductive bar is mounted inside a rotating sleeve which in turn is coupled to the cathode. During use coaction between the rotating sleeve and the stationary bar causes wear on one or both of the relatively rotating members. As the wear continues, it is possible that contact between the sleeve and bar will be lost in which case electroplating will cease.

A second problem accompanying prior art contact design is that the contact between rotating members is not protected from corrosive attack by the electrolyte in and around the barrel. The electrolyte can wear away the electrical contact and cause either an open circuit condition or at least reduced plating effectiveness. The presence of electrolyte in the contact area can also cause metal electrodeposition on the contact which increases the electrical resistance of the contact area.

SUMMARY OF THE INVENTION

The present invention relates to an improved electrical contact which maintains a low resistance path between the exterior of a rotating barrel and one or more electrodes mounted inside the barrel. The disadvantages noted with regard to the prior art are avoided by biasing two relatively rotating conductive portions of the electrical contact against each other. Such biasing maintains a low resistance path to the one or more electrodes even if frictional forces wear the relatively rotating portions. The region of electrical contact between relatively rotating members is sealed from the electrolyte to prevent corrosion and/or metal deposition by that liquid.

The improvement of the invention includes conductive means fixed to the barrel and electrically connected to the electrodes, the conductive means providing a flat contact surface, a contact member having a flat contact surface mounted on a conductor connected to a stationary source of electric potential, means holding the contact member against rotative movement, and spring means resiliently urging the flat contact surfaces into engagement during barrel rotation.

In the preferred embodiment of the invention, the conductive means is a plate mounted at one end of the barrel over an aperture defined by a barrel collar. The collar is supported by a stationary mounting hub which is secured to a barrel hanger. The conductor extends through an opening in the hub and includes a knob having a flat end portion which is biased against the plate by a compressed spring. Even though the contact between plate and knob becomes worn the spring continues to bias the two together to insure the plating electrodes are at a constant potential.

The knob or contact member on the conductor is held against rotative movement so that in case of any seizure between the knob and the plate, the knob will be prevented from twisting and damaging the conductor.

The region of electrical contact between the knob and the plate is sealed off from electrolyte in and around the plating barrel. Two O-rings which fit into grooves machined in the hub prevent solution seepage past an outside hub surface and a plastic sheath around the conductor prevents solution from outside the barrel from seeping into the hub opening. Corrosion and/or plating of the contact is thus avoided.

From the above it is apparent that one object of the present invention is to provide a wear resistant electrical contact which is isolated from the electrolyte in and around a plating barrel and which provides a low resistant path between one or more electrodes positioned inside a rotating plating barrel and a source of constant electrical potential outside the barrel. Such a contact insures that the rotating pieces inside the barrel are maintained at an appropriate electrical potential necessary to the plating process. Other features and advantages achieved through practice of the present invention will become more apparent upon consideration of the detailed description of a preferred embodiment of the invention which follows.

BRIEF DESCRIPTION OF THE DRAWINGS

FIG. 1 is an elevational view, partially in cross-section, showing a rotatable plating barrel including a number of electrodes connected to an electrical conductor outside the barrel.

FIG. 1A is an enlarged cross-sectional view of an electrical contact between the electrodes and the conductor.

FIG. 2 is an end elevation view of the plating barrel shown in FIG. 1.

DETAILED DESCRIPTION OF THE PREFERRED EMBODIMENT

Turning now to the drawings, FIGS. 1 and 2 show a plating barrel 10 rotatably supported by two hangers 11, 12. The illustrated barrel 10 is of a regular hexagonal cross-section shape and is comprised of a plurality of side wall panels 13 and a door 14. The door 14 can be removed so that workpieces to be plated can be inserted into the barrel. Plating barrels of this general construction are known and one such barrel is disclosed in U.S. Pat. No. 3,507,529 to Gill. That patent is incorporated herein by reference.

The side wall panels 13 are mounted between ribs 15 which extend between a pair of barrel heads 16, 17. The barrel heads 16, 17 can be secured to the panels 13 and the ribs 15 in a suitable manner such as by welding or cementing.

In FIG. 1A a portion of the barrel has been broken away to show details of the barrel mounting arrangement. Each barrel head 16, 17 includes a collar 21 which defines an axially aligned aperture or opening bounded by a cylindrical surface 18. Each hanger 11, 12 includes a hub 19 having a cylindrical outside surface which fits into the collar opening and contacts the cylindrical surface 18 through a sleeve bearing 20.

Once the workpieces have been placed inside the barrel, the door 14 is locked in place and the barrel is lowered into a plating solution. The solution is typically maintained in a plating vat which supports both the barrel 10 and a drive mechanism (not shown) which causes the barrel to rotate inside the vat. Various techniques for supporting and rotating plating barrels are known in the art and have therefore not been disclosed.

A number of strip contacts or electrodes 30 are attached to inwardly directed surfaces of the ribs 15 at spaced locations about the barrel by suitable connectors 31. The present invention provides an improved coupling or contact to maintain these strip contacts or electrodes 30 at a constant electrical potential. This potential is typically lower than the potential of plating anodes suspended inside the vat. During barrel rotation the workpieces contact the strip contacts 30 and are therefore also maintained at this lower constant potential. As a result plating current flows from the anodes to the workpieces and electroplating occurs.

Two insulated conductors 32 are connected to the constant electrical potential outside the barrel and extend through axially aligned openings in the hubs 19. Along their axial dimension each hub opening defines three inside surfaces 38, 39, 40. Two surfaces 38, 39 are circular in cross-section and define a lip 50 at their boundary. The third surface 40 has a square cross-section.

Each conductor 32 is covered by two layers 51, 52 of plastic insulating material. An outermost layer 51 comprises a sheath or sleeve movable with respect to the inner layer 52 which extends through the hub opening and includes a flared end portion 53 which abuts the lip 50. The innermost layer 52 is a conventional plastic insulator which is stripped off one end of the conductor 32.

Each conductor 32 is coupled to a conductive knob 33 having a square flat end surface which is biased against a conductive plate 34 attached to an inside surface of the barrel heads 16, 17. The strip contacts 30 include angled end portions 35 which abut the barrel heads 16, 17 and extend radially inward along an inside surface of those heads. The conductive plate 34 fits into a recess 36 defined by the barrel heads and is of a large enough diameter to underlie and contact each of the angled end portions 35. The plate 34 includes six apertures which are aligned with apertures in the flanged end portions to receive connectors 37 which thread into the barrel heads. When assembled the contacts 30, plate 34, and conductor 32 are all electrically connected so the contacts are maintained at a constant potential.

The knob 33 has an aperture which fits over both the exposed end portion of the conductor 32 and the inner layer 52 of plastic insulation. A square flanged portion 54 of the knob 33 fits inside the square cross-sectioned hub surface 40 so the knob remains stationary as the barrel heads and attached conductive plate 34 rotate.

A spring 55 fits inside the hub opening and biases the knob 33 against the plate 34. The spring contacts two bushings 56, 57 which abut the flared end portion 53 of the outermost conductor insulating layer 51 and the square flanged portion 54 of the knob 33 respectively. The spring 55 tends to separate the two bushings 56, 57 which in turn biases the knob 33 against the conductive plate 34.

Plating solution is prevented from contacting the region of contact between the plate 34 and the knob 33. A first O-ring seal 58 fits into a first groove in the hub 19 and prevents fluid from seeping past the plate 34 to contact the knob 33. A second O-ring seal 59 fits into a second groove machined into the hub and prevents solution from seeping past the barrel heads 16, 17 to the sleeve bearing 20. Since one of the two bushings 56 biases the flared end 53 of the outermost insulator 51 against the lip 50 solution cannot leak past the hub opening to the knob 33 so long as the insulator 52 extends above the solution level of the plating vat.

A plastic shield 70 is attached to the conductive plate 34 by suitable connectors 71. This plate prevents the workpieces inside the rotating plating barrel from contacting a significant portion of the conductive plate during plating operations. If desired, the plastic plate shield 70 could be constructed to fit over the angled end portion 35 of the contact strips 30 thereby entirely isolating the plate 34 from contact with the plating solution inside the barrel.

While a preferred embodiment of the invention has been disclosed in detail, various modifications or alterations may be made therein without departing from the spirit or scope of the invention set forth in the appended claims.

What is claimed is:

1. In a plating apparatus including a rotatable barrel having internal electrode means, and coupling means including a conductor for connecting a stationary source of electric potential to said electrode means, the improvement wherein said coupling means comprises conductive means fixed to said barrel and electrically connected to said electrode means, said conductive means providing a flat contact surface, a contact member having a flat surface mounted on said conductor, means holding said contact member against rotative movement, and spring means resiliently urging said flat surfaces into engagement.

2. The improvement as claimed in claim 1 wherein said conductive means comprises a plate secured to the inside of said barrel.

3. The improvement in claim 2 including a shield over said plate to guard it against contact with the articles being plated.

* * * * *